US011186903B2

(12) United States Patent
Skubich et al.

(10) Patent No.: US 11,186,903 B2
(45) Date of Patent: Nov. 30, 2021

(54) HIGH STRENGTH PRODUCTS EXTRUDED FROM 6XXX ALUMINUM ALLOYS HAVING EXCELLENT CRASH PERFORMANCE

(71) Applicants: CONSTELLIUM VALAIS SA, Sierre (CH); CONSTELLIUM SINGEN GMBH, Singen (DE)

(72) Inventors: Alexis Skubich, Zürich (CH); Martin Jarrett, Oxfordshire (GB)

(73) Assignees: CONSTELLIUM VALAIS SA, Sierre (CH); CONSTELLIUM SINGEN GMBH, Singen (DE)

( * ) Notice: Subject to any disclaimer, the term of this patent is extended or adjusted under 35 U.S.C. 154(b) by 570 days.

(21) Appl. No.: 15/508,243

(22) PCT Filed: Sep. 2, 2015

(86) PCT No.: PCT/EP2015/070000
§ 371 (c)(1),
(2) Date: Mar. 2, 2017

(87) PCT Pub. No.: WO2016/034607
PCT Pub. Date: Mar. 10, 2016

(65) Prior Publication Data

US 2017/0306465 A1 Oct. 26, 2017

(30) Foreign Application Priority Data

Sep. 5, 2014 (EP) ..... 14003062

(51) Int. Cl.

| | |
|---|---|
| ***C22F 1/05*** | (2006.01) |
| ***B21C 23/04*** | (2006.01) |
| ***C22F 1/00*** | (2006.01) |
| ***C22C 21/08*** | (2006.01) |
| ***C22C 21/02*** | (2006.01) |

(52) U.S. Cl.
CPC ..... *C22F 1/05* (2013.01); *B21C 23/04* (2013.01); *C22C 21/02* (2013.01); *C22C 21/08* (2013.01); *C22F 1/002* (2013.01)

(58) Field of Classification Search
None
See application file for complete search history.

(56) References Cited

U.S. PATENT DOCUMENTS

| | | | | |
|---|---|---|---|---|
| 5,027,634 | A † | 7/1991 | Visser | |
| 5,571,347 | A * | 11/1996 | Bergsma | C22C 21/08 148/415 |
| 6,685,782 | B1 | 2/2004 | Schwellinger | |
| 2014/0123719 | A1* | 5/2014 | Lukasak | C22C 21/08 72/253.1 |

FOREIGN PATENT DOCUMENTS

| | | | |
|---|---|---|---|
| EP | 0302623 | B1 | 1/1992 |
| EP | 0 676 480 | A1 | 10/1995 |
| EP | 0 808 911 | A1 | 11/1997 |
| EP | 1155156 | B1 | 11/2001 |
| EP | 2883973 | A1 | 6/2015 |
| JP | 04341546 | A * | 11/1992 |
| WO | 0030780 | A1 | 6/2000 |
| WO | 2013162374 | A1 | 10/2013 |

OTHER PUBLICATIONS

Davis, J.R. "Aluminum and Aluminum Alloys", ASM International, pp. 22, 23, 43, 68, 69, 309-312. (Year: 1993).*
International Search Report of PCT/EP2015/070000 dated Nov. 4, 2015.
Bichsel et al., Waermebehandlung. (1973) p. 173-192. English Translation.
Ou et al., "Impact of pre-aging on the tensile and bending properties of AA 6061" Scandinavian Journal of Metallurgy. (2005) 34:318-325.
Reiso et al., "The Effect of Billet Preheating Practice on Extrudability of AlMgSi Alloys" Proceedings of Fourth International Aluminum Extrusion Technology Seminar Volume II—Interactions (1988) 287-296.
O. Reiso., "Extrusion of AlMgSi Alloys" Proceedings of the 9th International Conference on Aluminum Alloys (2004) 32-46.
Reiso et al., "The Effect of Cooling Rate After Homogenization and Billet Preheating Practice on Extrudability and Section Properties" (1992) 1-10.

(Continued)

*Primary Examiner* — George Wyszomierski
*Assistant Examiner* — Janell C Morillo
(74) *Attorney, Agent, or Firm* — McBee Moore Woodward & Vanik IP, LLC

(57) ABSTRACT

An aluminium alloy extruded product obtained by casting a billet from a 6xxx aluminium alloy comprising:

Si: 0.3-1.5 wt. %; Fe: 0.1-0.3 wt. %; Mg: 0.3-1.5 wt. %; Cu<1.5 wt. %; Mn<1.0%; Zr<0.2 wt. %; Cr<0.4 wt. %; Zn<0.1 wt. %; Ti<0.2 wt. %, V<0.2 wt. %, the rest being aluminium and inevitable impurities;

Wherein an ageing treatment is applied such that the product presents an excellent compromise between strength and crashability, with a yield strength Rp0.2 higher than 240 MPa, preferably higher than 280 MPa and when axially compressed, the profile presents a regularly folded surface having cracks with a maximal length of 10 mm, preferably less than 5 mm.

18 Claims, No Drawings

(56) References Cited

OTHER PUBLICATIONS

Royset et al., "Almech—A Computer Program for Alloy Selection and Extrusion Process Involvement" Hydro Aluminum R&D Materials Technology (2004) 81-91.
Royset et al., "Al—Mg—Si Alloys with Improved Crush Properties" Hydro Aluminium R&D and Technology (2008) 1-16.
Strehmel et al., "Taper Quenching—Energieverschwendung?" Technology (2006) 926-933.
Jenista, "Taper Quenching, A Case Study," pp. 83-87, May 16-19, 2000, The Aluminum Association, Proceedings of the Seventh International Aluminum Extrusion Technology Seminar, Chicago, Illinois.†
Royset, "Al—Mg—Si Alloys with Improved Crush Properties," pp. 1-16, May 13-16, 2008, Extrusion Technology for Aluminum Profiles Foundation, Ninth International Aluminum Extrusion Technology Semimar, Orlando, Florida.†
Court, "Improved Performance in Al—Mg—Si (6xxx) Extruded, Structural Alloys Through Microstructural Control," pp. 395-402, Sep. 11-16, 1994, Georgia Institute of Technology, The 4th International Conference on: Aluminum Alloys, Their Physical and Mechanical Properties, Atlanta, Georgia.†

* cited by examiner
† cited by third party

HIGH STRENGTH PRODUCTS EXTRUDED FROM 6XXX ALUMINUM ALLOYS HAVING EXCELLENT CRASH PERFORMANCE

CROSS REFERENCE TO RELATED APPLICATIONS

This application is a § 371 National State Application of PCT/EP2015/070000, filed Sep. 2, 2015, which claims priority to European Application No. 14003062.8 filed Sep. 5, 2014.

BACKGROUND OF THE INVENTION

Field of the Invention

The invention relates to AA6xxx-series aluminium alloy extruded products in either solid or hollow form particularly suitable for manufacturing automotive, rail or transportation structural components, such as crash management systems, which should have simultaneously high mechanical properties, typically a tensile yield strength higher than 240 MPa, preferably higher than 280 MPa, and excellent crash properties.

Description of Related Art

Unless otherwise stated, all information concerning the chemical composition of the alloys is expressed as a percentage by weight based on the total weight of the alloy. "6xxx aluminium alloy" or "6xxx alloy" designate an aluminium alloy having magnesium and silicon as major alloying elements. "AA6xxx-series aluminium alloy" designates any 6xxx aluminium alloy listed in "International Alloy Designations and Chemical Composition Limits for Wrought Aluminum and Wrought Aluminum Alloys" published by The Aluminum Association, Inc. Unless otherwise stated, the definitions of metallurgical tempers listed in the European standard EN 515 will apply. Static tensile mechanical characteristics, in other words, the ultimate tensile strength $R_m$ (or UTS), the tensile yield strength at 0.2% plastic elongation $R_{p0,2}$ (or YS), and elongation A % (or E %), are determined by a tensile test according to NF EN ISO 6892-1.

The crash behavior depends essentially on the material properties, the design and dimensions of the crash element. Aluminium alloy compositions and tempers have been developed for obtaining satisfying crash performance—also called "crashability" or "crashworthiness"—in crash relevant car components or structures, in particular when they are made from extruded products. A key requirement for the suitability of a material in a given design and dimension is the ability to exhibit a high energy absorption capacity through plastic deformation, characterized by regular folding of profile faces, without or with limited crack formation without fragmentation. Numerous dynamic crash tests, including low-speed quasi-static test, are used to assess the crash performance of a material. There are standards specific to automotive suppliers in terms of speed, profile geometries, length as the Volkswagen TL 116. They have all in common the same principle which consists in applying an axial compression load on an extruded hollow profile cut at a predefined length. The test consists in applying an axial compression load on one end, the other end being blocked by a support platen, and measuring the load while maintaining a controlled displacement of the profile It is of interest to observe the behavior of the profile during the deformation, in particular what are the defects induced by the deformation. In order to ensure the crush test allows to distinguish material performances without any bias from extrusion shape, the same section is preferentially be used on all evaluated materials and the latter is to be chosen so as to ensure repeatable folding to avoid any bias from geometry such as rectangular or circular tubes with no more than 2 cavities. The one skilled in the art knows. According to this test, materials having very poor crash performance are distorted by buckling and/or irregularly folded with numerous deep cracks on the folded surface. The surface of materials having better crash performance is plastically deformed by regular progressive folding. The surface of crushed samples of well crashable materials should have regularly positioned folds, ideally without any crack. However, cracks can be observed even on well crushable materials, but they have very small lengths, typically less than 10 mm, preferentially less than 5 mm and more preferentially less than 1 mm. The general aspect of the crushed sample and the maximal length of the cracks occurred during progressive folding are used to assess the crash performance of the tested material.

Solidus Ts is the temperature below which the alloy exhibits a solid fraction equal to 1. Solvus defines the temperature, which is the limit of solid solubility in the equilibrium phase diagram of the alloy. For high strength requirements, eutectic alloying elements such as Si, Mg and Cu should be added to form precipitated hardening phases. However, the addition of alloying elements generally results in a decrease in the difference between solidus and solvus temperatures. When the content of eutectic alloying elements is higher than a critical value, the solidus to solvus range of the alloy becomes a narrow "window", with typically a solidus to solvus difference lower than 20° C., and consequently the solution heat treatment of the aforementioned elements usually achieved during extrusion cannot be obtained without observing incipient melting. Indeed local temperature gradients achieved during extrusion generally exceed 20° C. implying that, as Solvus is reached, parts of the profile will display temperatures in excess of solidus Ts. Such alloys are considered as a non-extrudable alloy or extrudable solely if post extrusion separate solutionising is applied.

From the prior art it is known that for conventionally extruded aluminium alloy products an increased level of strength deteriorates properties related to the ductility, such as elongation or crash performance. In order to achieve high tensile yield strength, typically higher than 240 MPa, preferably higher than 280 MPa, while retaining high crash performance with 6xxx alloys, some technical solutions have been suggested. One of them is a process described in European patent EP 2 563 944, where the applied 6xxx-series aluminium alloy contains high contents of Mg and Si for forming hardening particles and peritectic elements such as Ti or V, and wherein strong Mg excess is needed, because it limits the diffusion of Si to grain boundaries, and as a result apparently improves damage tolerance and crashworthiness. However, the extrudability of such alloys is particularly low because of the necessary high Mg content (the preferred Mg content of EP 2 563 944 is between 0.65 wt. % and 1.2 wt. %).

SUMMARY

The applicant decided to develop a method for manufacturing high strength crashable AA6xxx alloy extrusions, which are obtained with a more acceptable extrusion speed in either solid or hollow form and have simultaneously a tensile yield strength higher than 240 MPa, preferably higher than 280 MPa and an excellent crash performance, as assessed by dynamic crash testing. A first object of the invention is an aluminium alloy extruded product obtained by following steps:

a) casting a billet from a 6xxx aluminium alloy comprising:
   Si: 0.3-1.5 wt. %; Fe: 0.1-0.3 wt. %; Mg: 0.3-1.5 wt. %; Cu<1.5 wt. %; Mn<1.0%; Zr<0.2 wt. %; Cr<0.4 wt. %; Zn<0.1 wt. %; Ti<0.2 wt. %, V<0.2 wt. %, the rest being aluminium and inevitable impurities;
   wherein the content of eutectic forming elements (Mg, Si and Cu) is selected so as to present in equilibrium conditions a solidus to solvus temperature difference higher than 5° C., preferably 20° C.;
b) homogenizing the cast billet at a temperature $T_H$, which is 30° C. to 100° C. lower than solidus temperature Ts, which is typically between 565° C. and 620° C.;
c) heating the homogenized billet to a temperature $T_h$ between Ts and (Ts−45° C.) and superior to solvus temperature for a time long enough to ensure a complete dissolution of precipitated eutectic phases;
d) cooling until billet temperature reaches a temperature Td between 400° C. and 480° C. while ensuring billet surface never goes below a temperature substantially close to 350° C., preferably 400° C.;
e) extruding immediately, i.e. at most a few tens of seconds after the cooling operation, the said billet through a die to form at least a solid or hollow extruded product. The extrusion speed is advantageously such that the surface temperature of the extrudate is higher than 430° C., preferably 460° C., and lower than solidus, commonly ranging from 500° C. to 580° C.;
f) quenching the extruded product down to room temperature;
g) stretching the extruded product to obtain a plastic deformation, typically between 0.5% and 5% or even more (up to 10%);
h) ageing the extruded product, without beforehand applying on the extruded product any separate post-extrusion solution heat treatment the ageing treatment being applied such that
   Tensile test samples machined on the profile obtained according the method described above exhibits a Rp0.2 higher than 240 MPa, preferably higher than 280 MPa
   A hollow extrusion which have globally a rectangular cross-section, approx. 40*55 mm with a wall thicknesses close to 2.5 mm is produced according to steps a) to h), to evaluate the crushability
      The crash test samples cut from the said extrusion provides a regularly folded surface having cracks with a maximal length of 10 mm, preferably 5 mm, when axially compressed such that the crush distance is higher than half the length of the initial cut extrusion.
      The Tensile test samples machined from the said extrusion have a yield strength Rp0.2 higher than 240 MPa, preferably higher than 280 MPa.

DETAILED DESCRIPTION OF A PREFERRED EMBODIMENT

Crash test samples cut from the said profile provided with a regularly folded surface having cracks with a maximal length of 10 mm, preferably 5 mm, more preferably 1 mm, when axially compressed such that the crush distance is higher than half their length.

Tensile test samples machined on the profile near the crash test samples having Rp0.2 higher than 240 MPa, preferably higher than 280 MPa Preferably, the ageing treatment is made in two successive steps:

h1) naturally age the extruded product minimum 1 hour, preferably more than 48 hours in order to maximize material strength at peak age condition.
h2) artificially age the extruded product to T6 or T7 temper, using either a one- or multi-step heat treatment applied at temperature(s) typically between 150° C. and 200° C. for a period of time between 1 and 100 hours defined to achieve the targeted combination of strength and crash performance.

According to the invention, the aluminium alloy extruded product is obtained by casting a billet from a 6xxx aluminium alloy comprising: Si: 0.3-1.5 wt. %; Fe: 0.1-0.3 wt. %; Mg: 0.3-1.5 wt. %; Cu<1.5 wt. %; Mn<1.0%; Zr<0.2 wt. %; Cr<0.4 wt. %; Zn<0.1 wt. %; Ti<0.2 wt. %, V<0.2 wt. %, the rest being aluminium and inevitable impurities. The aluminium alloy according to the invention is of the AlMgSi type, which, compared with other such as e.g. AlZnMg alloys, provides good preconditions in the form of elongation and formability for energy-absorbing parts.

Preferably, the Mg and Si contents are relatively low, i.e. both lower than 1.0%, to have an alloy easy to be extruded. Preferably, there is not Mg in excess. Advantageously, the Mg/Si weight ratio is largely lower than stoichiometric weight ratio corresponding to Mg2Si (1.73), typically lower than 1. More preferably, Mg content is not higher than 0.7 wt. %. Even more preferably, Mg content is not higher than 0.6 wt. %. In order to obtain an adequate level of strength, the alloy according to the invention contains also preferably copper and/or dispersoid-forming element additions such as Mn, Ti, Zr, Cr, V or Nb.

In some embodiments of the invention, copper is added with a content higher than 0.05% to have a strengthening effect and lower than 0.4 wt. % to keep a chance to have a solidus to solvus difference higher than 5° C., preferably higher than 20° C.

From U.S. Pat. No. 6,685,782, it is known that a peritectic alloying element, such as vanadium has a positive effect on the crash performance of the 6xxx-series aluminium alloys. Therefore, in some embodiments of the invention, peritectic alloying elements are advantageously added, solely or in combination, typically Ti with a content higher than 0.01 wt. % and preferably lower than 0.1 wt. %, Nb with a content higher than 0.02 wt. % and preferably lower than 0.15 wt. % or V with a content higher than 0.01 wt. % and preferably lower than 0.1 wt. %. Other peritectic alloying elements such as Mo, preferably with content lower than 0.2%, or even Hf and Ta, can be added.

By applying the overheat and quench steps c) and d) of the invention on dispersoid containing alloys including, but not limited to, Mn, Cr, Ti and Zr, especially if homogenized at low temperatures as suggested in homogenisation step b) of the invention, the manufacture of high strength extruded products is enabled, which have a better crash performance, probably because they have large non-recrystallised areas displaying fibrous structure with more retained deformation texture, than when using the conventional separate post extrusion solution heat treatment, the latter enabling material with high strength but inevitably leading to post deformation recovery and recrystallisation.

The cast billet according to the invention is homogenised. Because of the heat treatment of step c), the homogenisation treatment may be carried out—typically between 3 and 10 hours—with a quite low homogenisation temperature, i.e. with $T_H$ between 30° C. and 100° C. lower than solidus. Typically, the cast billet is homogenised at a temperature between 480° C. and 575° C. The homogenised billet is then cooled down to room temperature.

The homogenised cast billet to be extruded is heated to a temperature Th slightly below the solidus temperature Ts to be solution heat treated. According to the invention, this temperature is between Ts−45° C. and Ts. The heating temperature is significantly higher than the conventional heating temperature, which is generally 50° C. to 150° C. lower than Ts. Therefore step c) is called "overheat" by reference to the conventional practice. The billets are preferably heated in induction furnaces and hold at Th during ten seconds to several minutes, typically between 80 and 120 seconds, i.e. for a time long enough to ensure a complete dissolution of precipitated eutectic phases.

The billet is then cooled preferably by water-spray or water-bath until its temperature reaches 400° C. to 480° C., while ensuring that the billet surface never goes below a temperature substantially close to 350° C., preferably 400° C. Some trials seem to show that the temperature of the billet surface can be lower than 400° C., even if precipitation of some constituent particles, in particular hardening particles such as $Mg_2Si$ or Al2Cu, can at least partially occur. We assume that these particles, if any, will be dissolved during extrusion because they are located in the periphery of the metal billet, which feeds the narrow area extending along the dead zone that is formed close to the die during the extrusion. The material issuing from the periphery of the billet flows through this area and is prone to very intense shear stresses. As a result of the very high shear strain rates imposed and the heat generated in this area, the particles, if any, are probably dissolved during the extrusion, such that the surface of the profile exiting from the die is free of the said particles.

Anyway the billet must be cooled, preferably quenched with a high cooling rate, by controlling the mean temperature of the billet and checking that the surface temperature is higher that a temperature close to 350° C., i.e. largely higher than the ambient. This implies that the cooling step d) has to follow an operating route, which should be predefined, for example by experimentation or through numerical simulation in which at least the billet geometry, the thermal conductivity of the alloy at different temperatures and the heat transfer coefficient associated with the cooling means are taken into account.

FEM simulation of the cooling of a Ø 254 mm diameter billet with a heat transfer coefficient of 1 $kW/m^2/°$ K shows that the cooling should be stopped after approximately 40 s to avoid that the billet surface is below 400° C. At that time, the temperature of billet core is still near 530° C. but 40 seconds later, the temperature is again almost homogeneous in the billet, i.e. approximately 480° C. in the core and near the surface, because of the high thermal conductivity of the aluminium alloy.

For billets having higher diameters, the cooling means should have higher cooling power or, if the same cooling means is used, cooling should be made in several steps including intense cooling, cooling stop when surface temperature is near 400° C., holding the billet few seconds such that the core and the surface temperatures are close each to the other and start a new similar cooling step as long as the mean temperature of the billet is higher than 480° C.

For billets having lower diameters, cooling means can be used, which has lower cooling power or, if the same cooling means is used, cooling should be stopped after a shorter time, which can be estimated by an appropriate numerical simulation.

As soon as the billet temperature reaches a temperature between 450° C. to 480° C., i.e. a few tens of seconds after the cooling operation is stopped, the billet is introduced in the extrusion press and extruded through a die to form one or several solid or hollow extruded products or extrudates. The extrusion speed is controlled to have an extrudate surface exit temperature higher than 430° C., preferably 460° C., but lower than solidus temperature Ts. The exit temperature may be quite low, because, as a result of steps c) and d), alloying elements forming hardening precipitates are still in solution in the aluminium lattice. The exit temperature should be high enough to merely avoid precipitation. Practically, the targeted extrudate surface temperature is commonly ranging from 500° C. to 580° C., to have an extrusion speed compatible with a satisfying productivity.

The extruded product is then quenched at the exit of the extrusion press, i.e. in an area located between 500 mm and 5 m of the exit from the die. It is cooled down to room temperature with an intense cooling device, e.g. a device projecting sprayed water on the extrudates. The extrudates are then stretched to obtain a plastic deformation typically between 0.5% and 5% or even more (up to 10%), in order to have stress-relieved straight profiles.

The profiles are then aged without beforehand applying any separate post-extrusion solution heat treatment to achieve the targeted strength and crash performance. The ageing treatment is made in two successive steps. First a natural ageing step of minimum 1 hour, preferably more than 48 hours, is applied in order to maximize material strength at peak age condition. Then a one- or multiple-step artificial aging treatment is applied at temperature(s) ranging from 150 to 200° C. for a prescribed period of time, between 1 to 100 hours, depending on the targeted properties. The alloy and the process according to the invention are particularly well suited to obtain T6 temper or T7 tempers, in order to achieve Rp0.2 higher than 240 MPa, preferably higher than 280 MPa while displaying an excellent crash performance characterised by crushed samples, the surface of which is regularly folded without any crack or with cracks having a maximum length of 10 mm, preferably 5 mm, more preferably 1 mm.

The crash performance is evaluated on all described alloy and temper combinations using an identical extrusion shape. It corresponds to a hollow extrusion which has globally a rectangular cross-section, approx. 40*55 mm with a wall thicknesses close to 2.5 mm. Crushed samples are cut to a given length. It is preferred to use a length between 3 and 10 times, more preferably 4 and 7 times the radius of gyration of the profile cross-section. Cut profile are then axially compressed, typically by using a hydraulic press having flat dies. For crash samples made from crushable aluminium alloy materials, the compression force is increasing at the beginning of the test, until the beginning of folding; when the folding starts, the compression force is substantially constant, slightly varying during progressive folding. The crush distance is reached when the compression force increases significantly. The crush distance is generally higher than half the length of cut profile. The general aspect of the crushed sample and its folded surface are observed once the crush distance is reached. The level of the crash performance is given by measuring the maximal length of the cracks appearing on the folded surface.

Another object of the invention is the use of an aluminium alloy extruded product according to the invention to manufacture parts of structural components for automotive, rail or transportation applications, such as crash boxes or crash management systems.

Example

Hollow profiles made from two 6xxx aluminium alloys (A, B) were extruded by following two different process routes: the current prior art route and the route according to the invention. The chemical compositions of these alloys are shown on Table I. Alloy A is an AA6008 alloy. Alloy B is an AA6560 alloy.

TABLE I

| Alloy | Si | Mg | Mn | Fe | Cu | Cr | Zn | Ti | V |
|---|---|---|---|---|---|---|---|---|---|
| A | 0.60 | 0.53 | 0.08 | 0.24 | 0.14 | 0.009 | 0.03 | 0.024 | 0.071 |
| B | 0.47 | 0.54 | 0.06 | 0.2 | 0.18 | 0.002 | 0.01 | 0.035 | — |

Homogenized cast billets having a diameter of 254 mm and a length of 820 mm were heated, introduced into an extrusion press and pressed to form mono-chamber hollow profiles, which have globally rectangular cross-section, approx. 40*55 mm with a wall thicknesses close to 2.5 mm. This geometry is representative of hollow profiles used in automotive industry to manufacture crash boxes and corresponds to a geometry suited to evaluate the crashworthiness. Profiles were cut at 200 mm length to form crash test specimens. This length corresponds to approximately 10 times the radius of gyration of said profile, calculated around the axis corresponding to the width direction of the rectangular shape. Tensile test specimens were machined in the hollow profiles near the crash test specimens.

200 mm long crash test specimens were then crushed between two flat dies by axial compression at a displacement speed of 320 mm/min using a hydraulic press until a displacement of 125 mm was achieved. Folds generated under compression load were then observed and measured. The crush distance reached was higher than 100 mm.

Profiles A-2, A-3 and B-2 were obtained by following a conventional route:

- Homogenising cast billets at a temperature close to 575° C.;
- Heating the homogenised cast billets to a temperature close to 460° C.;
- Extruding the said billet with a surface exit temperature higher than 530° C. and lower than 580° C., in order to avoid incipient melting due to non-equilibrium melting of precipitates formed from solute elements (e.g. Mg2Si, Al2Cu) in profile hot-spots but still allows to dissolve part of the aforementioned phases that will later by re-precipitation during ageing contribute to hardening the alloy.
- Quenching the extruded material with an intense cooling device (water quench) down to room temperature.
- Stretching 1%
- ageing heat treatment at temperatures ranging from 150 to 200° C.; in particular A-2 and B-2 were heated during 7 h at 190° C., A-3 was heated during 8 h at 170° C.

Profiles A-1 and B-1 were obtained by following a route according to the invention.

- Homogenising cast billets at a temperature close to 575° C.
- Heating the homogenised cast billets to a temperature close to 575° C.
- Cooling by water-spray until billet temperature reaches a temperature Td close to 430° C. while ensuring billet surface never goes below a temperature substantially close to 350° C.;
- A few tens of seconds after the cooling operation, extruding the billet with a surface exit temperature higher than 500° C. and lower than 580° C.;
- Quenching the extruded material with an intense cooling device (water quench) down to room temperature.
- Stretching 1%
- Ageing to T7 temper by a two successive-steps heat treatment.; in particular A-1 and B-1 were naturally aged during 48 h at ambient temperature and heated during 7 h at 190° C.

TABLE 2

| | Base alloy | Process | Temper | Rm [MPa] | Rp0.2 [MPa] | A% [%] | Crash performance |
|---|---|---|---|---|---|---|---|
| A-1 | AA 6008 | Invention | T7 | 301 | 288 | 14.7 | Regular folds<br>Crack maximal length <5 mm |
| A-2 | AA 6008 | Conventional | T7 | 280 | 265 | 12.1 | Regular folds<br>Crack maximal length between 5 mm and 10 mm |
| A-3 | AA 6008 | Conventional | T6 | 296 | 277 | 14.1 | Regular folds<br>Crack maximal length between 25 mm and 50 mm |
| B-1 | AA 6560 | Invention | T7 | 283 | 267 | 14.9 | Regular folds<br>Crack maximal length <5 mm |
| B-2 | AA 6560 | Conventional | T7 | 270 | 253 | 12.5 | Regular folds<br>Crack maximal length between 5 mm and 10 mm |

The results of table 2 show that the process route according to the invention enables the manufacture of aluminium alloy extruded products having simultaneously better strength (Rm and Rp0.2) and crash performance than products obtained by a conventional route.

At iso design, it is well observed that according to the invention, it is possible to obtain simultaneously strength and crashworthiness. By using a conventional route, it is possible to increase the strength at a level of the invention by adjusting the ageing conditions (case A-2 and A-3) but it is observed that it deteriorates the crushability: the length of defects increases.

The invention claimed is:

1. A method of producing an extruded product comprising:

a) casting a billet from a 6xxx aluminium alloy, wherein the 6xxx alloy comprises:
Si: 0.3-1.0 wt. %;
Fe: 0.1-0.3 wt. %;
Mg: 0.3-0.7 wt. %;
Cu<1.5 wt. %;
Mn: 0.1-1.0 wt. %;
Zr<0.2 wt. %;
Cr<0.4 wt. %;
Zn<0.1 wt. %;
Ti<0.2 wt. %,
V<0.2 wt. %,
the remainder being aluminium and inevitable impurities;
wherein the content of eutectic forming elements (Mg, Si and Cu) is selected so as to present in equilibrium conditions a solidus to solvus difference greater than 5° C.;

b) homogenizing the cast billet at a temperature 30° C. to 100° C. lower than solidus temperature;

c) heating the homogenized billet at a temperature between Ts and (Ts−45° C.) and higher than solvus temperature for a time long enough to ensure a complete dissolution of precipitated eutectic phases;

d) quenching with a water quench until billet temperature reaches a temperature between 400° C. and 480° C. while ensuring billet surface never goes below a temperature of about 350° C.;

e) forming an extruded product;

f) quenching with a water quench the extruded product to room temperature;

g) optionally stretching the extruded product to obtain a plastic deformation of from 0.5% to 5%;

h) ageing the extruded product to obtain a T7 temper such that:
the tensile test samples from said extrusion product have a yield strength Rp0.2 higher than 240 MPa;
when a hollow extrusion which has a rectangular cross-section, approximately 40*55 mm with wall thicknesses of about 2.5 mm is produced according to a) to h), to evaluate the crushability:
crash test samples cut from said extrusion provide a regularly folded surface having cracks with a maximal length of 10 mm when axially compressed such that the crush distance is higher than half the initial cut profile length;
the tensile test samples from said extrusion have a yield strength Rp0.2 higher than 240 MPa.

2. The method of claim 1, wherein in h), the crash test samples cut from a hollow extrusion provide a regularly folded surface having cracks with a maximal length of 5 mm when axially compressed such that the crush distance is higher than half the initial cut profile length.

3. The method of claim 1, wherein the ageing (h) comprises two successive steps:
h1) naturally ageing the extruded product for a minimum of 1 hour,
h2) artificially ageing the extruded product to T7 temper, to obtain said crash performance and strength.

4. The method of claim 1, wherein said 6xxx aluminium alloy comprises Cu: 0.05-0.4 wt. %.

5. The method of claim 1, wherein said 6xxx aluminium alloy comprises one or more of Ti: 0.01-0.1 wt. %; V 0.01-0.1 wt. %; or Nb 0.02-0.15 wt. %.

6. The method of claim 1, comprising (e) forming an extruded product by extruding a billet through a die after the quenching operation.

7. The method of claim 1, comprising (e) forming an extruded product by immediately extruding a billet after the cooling operation.

8. The method of claim 1, wherein the tensile test samples from said extrusion product have a yield strength Rp0.2 higher than 280 MPa.

9. The method of claim 1, comprising (h) ageing the extruded product without previously applying any separate post-extrusion solution heat treatment on the extruded product.

10. The method of claim 1, wherein in h), the crash test samples cut from a hollow extrusion provide a regularly folded surface having cracks with a maximal length of 1 mm when axially compressed such that the crush distance is higher than half the initial cut profile length.

11. The method of claim 1, wherein the ageing (h) comprises two successive steps:
(h1) naturally ageing the extruded product for more than 48 hours;
(h2) artificially ageing the extruded product to T7 temper, to obtain the said crash performance and strength.

12. The method of claim 1, wherein the content of eutectic forming elements (Mg, Si and Cu) is selected to present in equilibrium conditions a solidus to solvus difference greater than 20° C.

13. The method of claim 1, comprising (c) heating the homogenized billet at the temperature between Ts and (Ts−45° C.) for ten seconds to 120 seconds.

14. The method of claim 1, comprising (c) heating the homogenized billet at the temperature between Ts and (Ts−45° C.) for from 80 seconds to 120 seconds.

15. The method of claim 1, comprising stretching the extruded product to obtain a plastic deformation of from 0.5% and 5%.

16. The method of claim 1, comprising:
casting a billet from a 6xxx aluminium alloy, wherein the 6xxx alloy consists of:
Si: 0.3-1.0 wt. %;
Fe: 0.1-0.3 wt. %;
Mg: 0.3-0.7 wt. %;
Cu<1.5 wt. %;
Mn: 0.1-1.0 wt. %;
Zr<0.2 wt. %;
Cr<0.4 wt. %;
Zn<0.1 wt. %;
Ti<0.2 wt. %,
V<0.2 wt. %,
the remainder being aluminium and inevitable impurities.

17. The method of claim 1, wherein said quenching in (d) comprises water-spraying or water-bathing.

18. The method of claim 1, wherein said quenching in (d) follows a pre-defined operating route, wherein at least billet geometry, thermal conductivity of the alloy at different temperatures, and heat transfer coefficient associated with said quenching are taken into account.

* * * * *